US008499504B1

(12) United States Patent
Sherbakov et al.

(10) Patent No.: US 8,499,504 B1
(45) Date of Patent: Aug. 6, 2013

(54) PREFABRICATED BUILDING AND METHOD FOR CONSTRUCTING A BUILDING

(76) Inventors: Dennis Sherbakov, Minden (CA); Lev Blium, Thornhill (CA)

( * ) Notice: Subject to any disclaimer, the term of this patent is extended or adjusted under 35 U.S.C. 154(b) by 0 days.

(21) Appl. No.: 13/568,220

(22) Filed: Aug. 7, 2012

(51) Int. Cl.
*E04H 1/00* (2006.01)

(52) U.S. Cl.
USPC ..... 52/79.9; 52/79.1

(58) Field of Classification Search
USPC ..... 52/79.1–79.9
See application file for complete search history.

(56) References Cited

U.S. PATENT DOCUMENTS

| | | | |
|---|---|---|---|
| 3,707,811 | A | 1/1973 | Hampson |
| 3,745,730 | A | 7/1973 | Layne |
| 3,848,376 | A | 11/1974 | Elmore |
| 4,012,871 | A | 3/1977 | Netto et al. |
| 4,075,814 | A | 2/1978 | Theurer et al. |
| 5,193,325 | A | 3/1993 | Allison |
| 5,353,558 | A | 10/1994 | Shea, Sr. et al. |
| 7,856,762 | B2 | 12/2010 | Deisenroth et al. |
| 2005/0108957 | A1 | 5/2005 | Quesada |
| 2007/0163184 | A1 | 7/2007 | Olesch |
| 2007/0256369 | A1 | 11/2007 | Webb et al. |
| 2007/0266650 | A1 | 11/2007 | Cohen et al. |
| 2011/0162293 | A1 | 7/2011 | Levy |

*Primary Examiner* — Mark Wendell
(74) *Attorney, Agent, or Firm* — Perry + Currier Inc.

(57) ABSTRACT

A prefabricated building and method for constructing a building are provided. The prefabricated building includes a base, a first module and a second module each configured to fit within a predetermined volume. Each module includes a plurality of beams and a plurality of studs. The method for constructing a building involves prefabricating a first module, prefabricating a second module, packaging the modules for transportation, transporting the modules, and constructing the building using the modules.

20 Claims, 19 Drawing Sheets

PREFABRICATED BUILDING AND METHOD FOR CONSTRUCTING A BUILDING

FIELD

The present specification here relates in general to a field of modular construction of buildings, and more particularly to prefabricated modular construction of buildings.

BACKGROUND

Constructing buildings generally begins by clearing a site and laying a foundation. If the building is wooden-framed then a framework is constructed on the foundation which will support the boards, siding and roof. If the building is of brick construction, then courses of bricks are laid to construct the walls. Floors, beams and internal walls are constructed as the building develops, with plumbing and wiring for water and electricity being installed as appropriate during the construction process. Once the main structure is completed then internal fixtures such as lights and other figments are added. Other types of buildings, such as modular and metal buildings, are built in their own unique ways.

Existing building techniques suffer from various problems. For example, modular buildings are generally very uniform in appearance and design in order to accommodate mass manufacturing techniques. While this design limitation facilitates mass production and thereby provide potential for reduced costs and increased quality control, at the same time unique structural features cannot be accommodated. At the other end of the spectrum, custom built structures, by definition, permit a great deal of structural flexibility but at the same time, custom built structures are more expensive and complex to build and design.

SUMMARY

It is an object of the present invention to provide a prefabricating building and method for constructing a building that obviates or mitigates at least one of the disadvantages of the prior art.

In accordance with an aspect of the invention, there is provided prefabricated building. The prefabricated building includes a base. The prefabricated building also includes a first module for resting on the base. The first module includes a plurality of first module beams for forming a portion of a first horizontal plane. The first module also includes a plurality of first module studs for forming a first portion of a wall. The plurality of first module studs connects to the plurality of first module beams. In addition, the prefabricated building includes a second module for connecting to the first module. The second module includes a plurality of second module beams for forming a portion of a second horizontal plane. The second module also includes a plurality of second module studs for forming a second portion of the wall. The plurality of second module studs connects to the plurality of second module beams. The plurality of second module studs is configured to connect to the plurality of first module studs for connecting the first module to the second module. The first module and the second module are configured to fit within a predetermine volume.

The first module and the second module each can include electrical wiring.

The second module can include a first electrical system.

The second module can include a second electrical system.

The first electrical system can be configured to be connected to the second electrical system.

The first module beams can include galvanized steel.

The second module beams can include galvanized steel.

The first module studs can include galvanized steel.

The second module studs can include galvanized steel.

The predefined volume can be configured to fit within a shipping container.

The shipping container can be an intermodal shipping container.

The base can include an insulating material.

In accordance with an aspect of the invention, there is provided a method for constructing a building. The method involves prefabricating a first module having a plurality of first module beams for forming a portion of a first horizontal plane and a plurality of first module studs for forming a first portion of a wall. The plurality of first module studs connects to the plurality of first module beams. The method further involves prefabricating a second module having a plurality of second module beams for forming a portion of a second horizontal plane and a plurality of second module studs for forming a second portion of the wall. The plurality of second module studs connects to the plurality of second module beams. In addition, the plurality of second module studs is configured to connect to the plurality of first module studs. The method further involves packaging the first module and the second module for transportation. In addition, the method involves transporting the first module and the second module to a building location. Also, the method involves constructing the building using the first module and the second module. At least one of the first module or the second module is placed on a base.

Prefabricating the first module can involve prefabricating the first module at an off-site facility.

Prefabricating the first module can involve installing an electrical system.

Prefabricating the first module can involve installing a plumbing system.

Prefabricating the first module can involve installing fixtures.

Packaging can involve placing the first module in a first shipping container and can involve placing the second module in a second shipping container.

Placing the first module in a first shipping container can involve holding the module in place with a first bracket and placing the second module in a second shipping container can involve holding the module in place with a second bracket.

Constructing can involve connecting the first module to the second module using a connection mechanism.

BRIEF DESCRIPTION OF THE DRAWINGS

Reference will now be made, by way of example only, to the accompanying drawings in which.

DETAILED DESCRIPTION OF THE EMBODIMENTS

Figure 1:
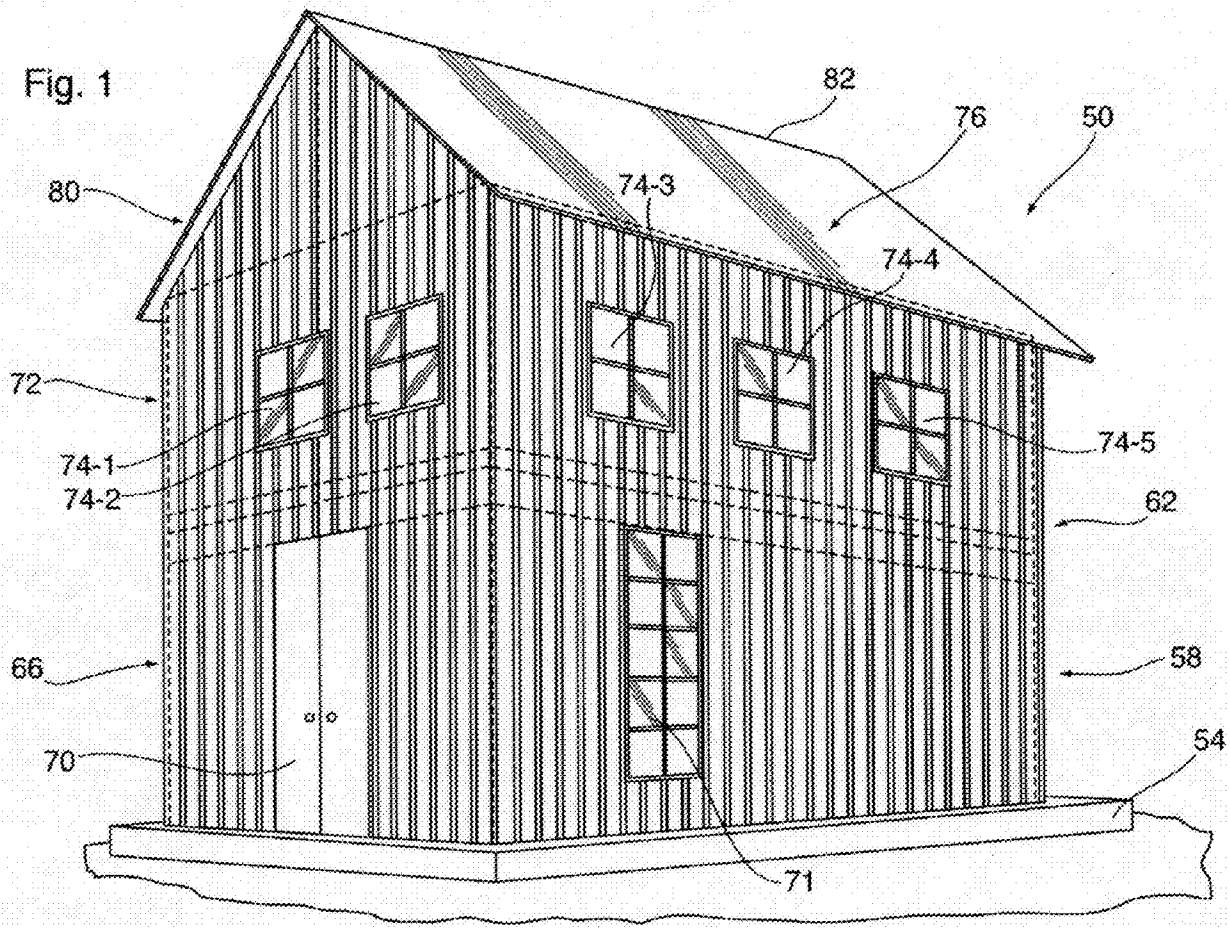
FIG. 1 is a perspective view of an prefabricated building according to an embodiment.
Figure 2:
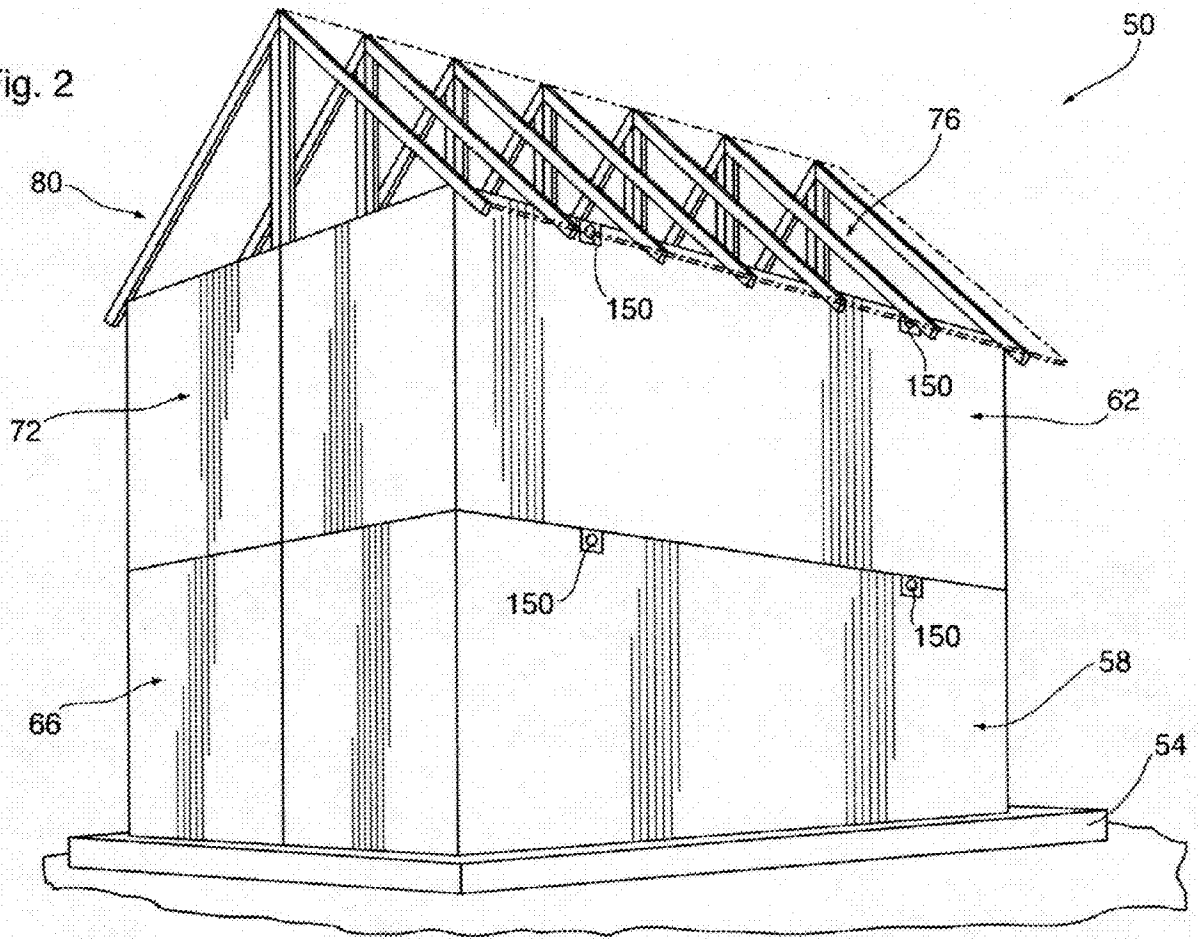
FIG. 2 is a schematic showing the modules of the embodiment of FIG. 1.

Referring to FIGS. 1 and 2, a prefabricated building is indicated generally at 50. It is to be understood that the building 50 is purely exemplary and that a variety of different prefabricated buildings are contemplated. For example, buildings can include a detached family home, a multi-unit residential dwelling, an office building, a retail building, a storage building, and other types of building. The building 50 includes a base 54, and a plurality of modules 58, 62, 66, 72, 76, and 80. Furthermore, the building 50 includes a door 70, a ground floor window 71, and a plurality of upper floor windows 74-1, 74-2, 74-3, 74-4, and 74-5.

The base 54 is generally configured to support the modules 58, 62, 66, 72, 76, and 80. In terms of providing physical support, the base 54 is mechanically designed to support at least the weight of the modules 58, 62, 66, 72, 76, and 80 and to support normal use associated with the building 50. For example, normal use can include placement of furniture, people moving throughout the building 50, placement of appliances or machinery, etc. Since various types of buildings are contemplated, it is to be appreciated by a person of skill in the art with the benefit of this description that the amount weight the base supports is dependent on the type of building constructed and the application of the building. For example, the base for a detached family home should be configured to support the modules 58, 62, 66, 72, 76, and 80, typical furniture of a family home, and a few people. As another example, the base for a storage building should be configured to support the modules and the items intended to be stored in the storage building. The base is typically constructed from materials which can provide support for the building 50 as well as withstand the environmental conditions associated with the location of the building 50. Some examples of suitable building materials include concrete, gravel, wood, bricks, and cinderblocks. In the present embodiment, the base 54 is a concrete slab resting on the ground.

The base 54 can be modified to include other features depending on the application and design of the building 50. For example, instead of being a concrete slab, the base 54 can be modified to be a concrete foundation upon which the modules 58, 62, 66, 72, 76, and 80 rest. It is to be appreciated that in embodiments where the base 54 is a foundation, the building 50 can include usable space below the ground surface, such as a basement or storage area. In other embodiments, the base 54 can be modified to include an insulating material such as foam or plastic. The insulating material can be used to thermally insulate the building 50 to improve energy efficiency related to climate control in the building 50. As another example, the insulating material can also be configured to be a vibration dampener to reduce vibration and or sound in the building 50.

Referring to FIG. 2, a schematic showing the positioning of the modules 58, 62, 66, 72, 76, and 80 is shown. In the present embodiment, the modules 58 and 62 have attachment points 150 to facilitate connecting the modules 58 and 62 to equipment, such as a crane, for moving and position the modules 58 and 62 during construction of the building 50. It is to be appreciated that in the present embodiment, the modules 58 and 62 have corresponding attachment points opposite of the attachment points 150 shown in FIG. 2. It is also to be understood, with the benefit of this description, that the modules 66 and 72 can have similar attachment points. Furthermore, the modules 76 and 80, which are not rectangular in shape can also have suitable attachment points (not shown) to facilitate connecting the modules 76 and 80 to equipment such as a crane. However, since the modules 76 and 80 are not rectangular in shape, the positioning of the attachment points would need to be placed such that the modules 76 and 80 can be lifted without tilting.

The modules 58, 62, 66, 72, 76, and 80 are generally configured to ultimately rest on the base 54 either directly or indirectly by connecting through another module. Each of the plurality of modules 58, 62, 66, 72, 76, and 80 are generally configured to provide a portion of usable space within the building 50. The manner in which each of the modules 58, 62, 66, 72, 76, and 80 provides a usable space is not particularly limited. For example, each of the modules 58, 62, 66, 72, 76, and 80 can include walls, window frames, door frames, pillars, and/or portions thereof. In terms of providing physical support for a usable space within the building 50, each of the modules 58, 62, 66, 72, 76, and 80 is constructed such that they are rigid enough to be support various structure components, fixtures, as well as the additional items which ultimately would use the space. Some examples of suitable materials used in the modules 58, 62, 66, 72, 76, and 80 can include steel, wood, plastics, aluminum, and galvanized steel. In the present embodiment each of the modules 58, 62, 66, 72, 76, and 80 is constructed from a frame of galvanized steel.

In the present embodiment shown in FIGS. 1 and 2, the frames of the modules 58, 62, 66, 72, 76, and 80 are shown in greater detail in FIGS. 3 to 8. The configuration of each of the modules 58, 62, 66, 72, 76, and 80 is different since the function of each of the modules 58, 62, 66, 72, 76, and 80 in the building 50 is different. For example, the modules 58 and 66 are generally configured to rest directly on the base. It is to be appreciated, with the benefit of this description, that the modules 58 and 66 together form a portion of the ground floor of the building 50.

Figure 3:
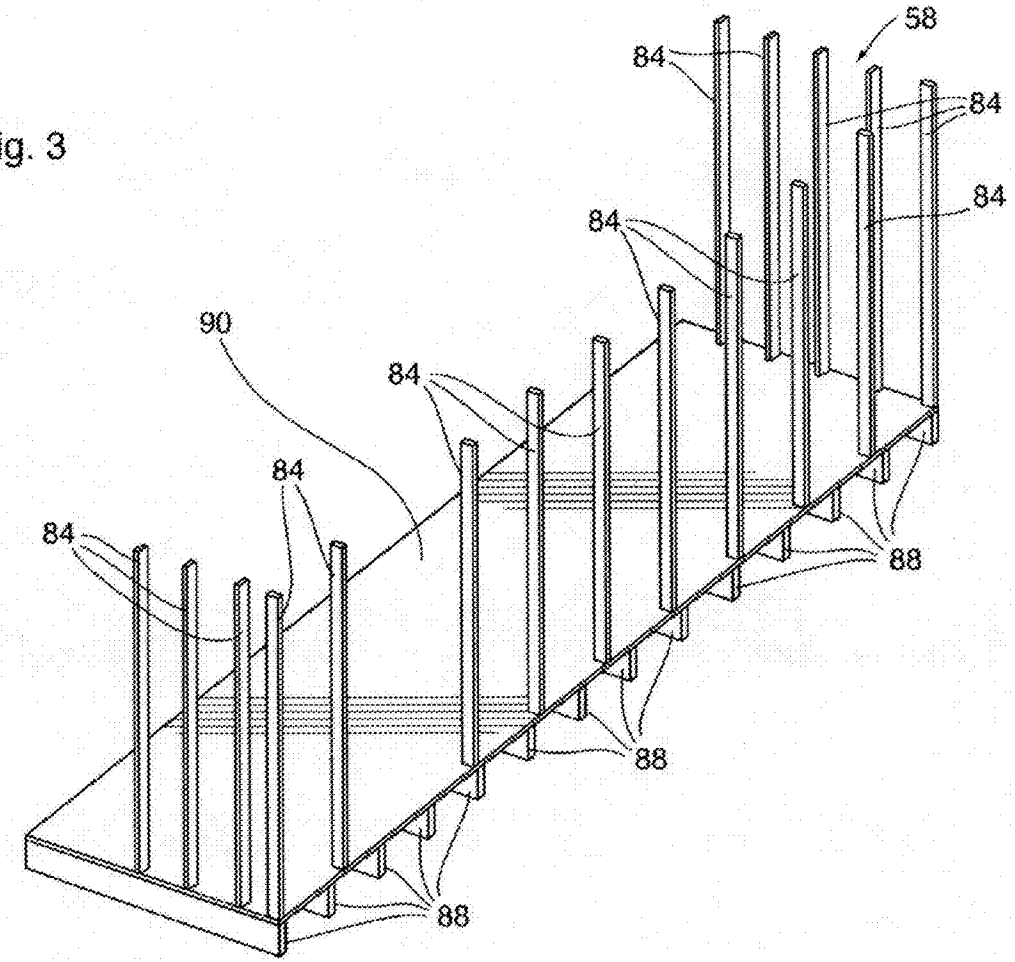
FIG. 3 is a perspective view of components of a module of the embodiment of FIG. 1.

Referring to FIG. 3, the module 58 includes a plurality of studs 84, a plurality of beams 88 and a floor 90. The studs 84 form a portion of three of the four vertical walls of the building 50 and are configured to provide structural support to the building 50. In terms of providing physical support, the studs 84 are mechanically structured and engineered to be able to support the load on each of the studs from the building as well as the load from any normal use associated with the building. In general, the studs 84 are regularly spaced. However, as shown in FIG. 3, there can be portions of a wall where studs are not present. For example, the absence of studs along a portion of a wall in FIG. 3 corresponds to an opening in the building 50, such as the door 70 or the window 71 shown in FIG. 1. In the present embodiment, the studs 84 are constructed from steel. However, the materials from which the studs 84 are constructed are not particularly limited can be modified to be any other type of suitable material such as wood, iron, plastics, and composites. It is to be re-emphasized that the structure shown in FIG. 3 is a non-limiting representation only. Notwithstanding the specific example, it is to be understood that other mechanically equivalent structures can be devised. For example, the studs 84 can be modified to be irregularly spaced. In another example, although the studs 84 are shown around the perimeter of the module 58, the studs 84 can be positioned in the interior of the module 58 to provide a support pillar or inner wall.

The beams 88 form a portion of a horizontal plane in the module 58. In the present embodiment, the beams 88 are configured to support the floor 90 and constructed from steel. However, the materials from which the beams 88 are constructed are not particularly limited can be modified to be any other type of suitable material such as wood, iron, plastics, and composites. Furthermore, as discussed above, the module 58 is configured to rest directly on the base 54. Therefore, in some variations, the module 58 can be modified to exclude the beams 88 and floor 90 if the base 54 can be used as a floor of the building 50. In the present embodiment, the floor 90 can also serve to protect the base 54 from excessive wear and damage.

Figure 4:
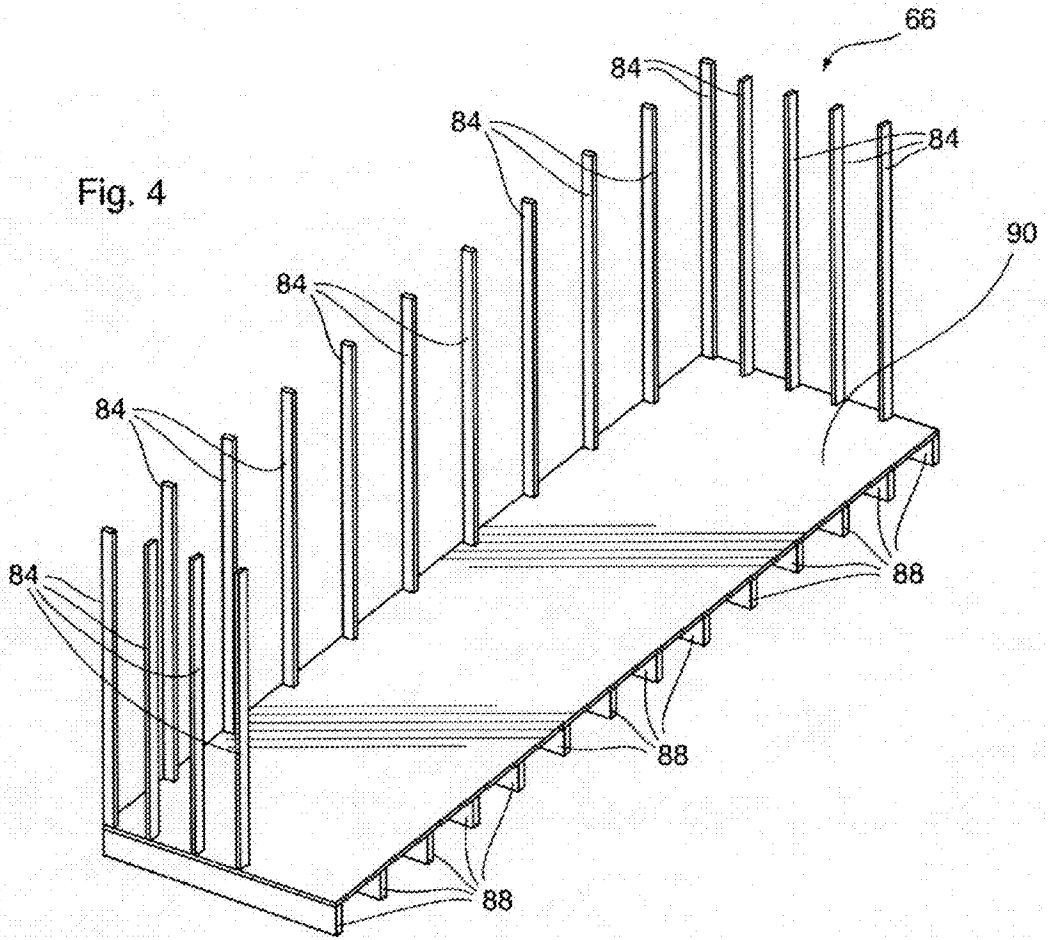
FIG. 4 is a perspective view of components of another module of the embodiment of FIG. 1.

Referring to FIG. 4, the module 66 generally has a mirrored structure to that of the module 58. In particular, the module 66 also includes a plurality of studs 84, a plurality of beams 88 and a floor 90. The modules 58 and 66 are generally configured to be connected. In the present embodiment, the modules 58 and 66 are configured to form a portion of the ground floor of the building 50 when connected. It is to be understood that the manner of connecting the modules 58 and 66 are not particularly limited and several different manners of connecting the modules 58 and 66 are contemplated and can include various fasteners, discussed in greater detail below, to fasten the beams 88 of the module 58 to the corresponding beams 88 of the module 66 to form a larger horizontal plane across both of the modules 58 and 66. In other embodiments, the modules 58 and 66 can be connected by positioning the modules 58 and 66 adjacent to each other on the base 54 and using the frictional force between each of the modules 58 and 66 and the base 54 to hold the modules 58 and 66 in place. It is to be appreciated that the absence of the absence of studs along a portion of a wall in FIG. 4 also corresponds to an opening in the building 50. In this particular embodiment, the absence of studs is configured to allow for the door 70. It is to be now appreciated, with the benefit of this description, that features of the building 50, such as openings are not limited by the dimensions of a module and can span across more than one module.

Figure 5:
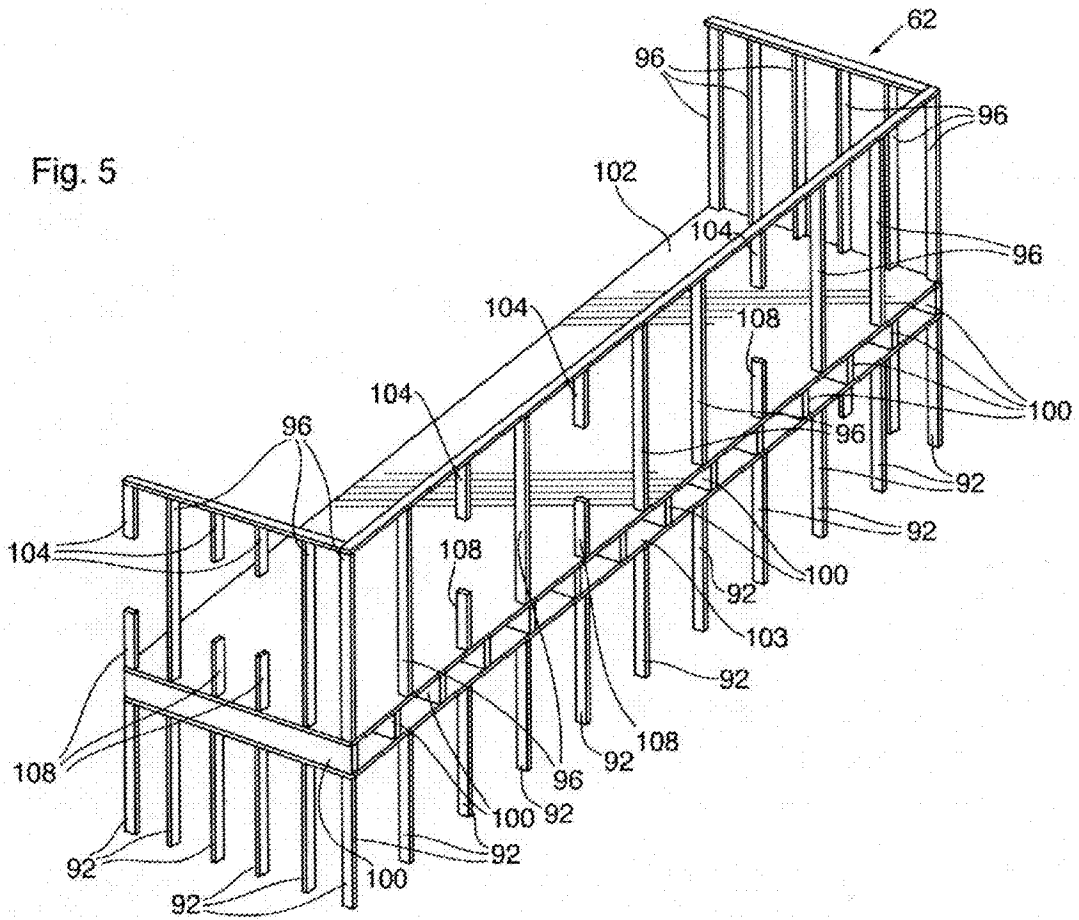
FIG. 5 is a perspective view of components of yet another module of the embodiment of FIG. 1.

Referring to FIG. 5, the module 62 includes a lower plurality of studs 92, an upper plurality of studs 96, a plurality of beams 100, a floor 102, a ceiling 103, and shorter studs 104 and 108. The module 62 is generally configured to connect directly to the module 58.

In the present embodiment, the lower plurality of studs 92 form a portion of three walls of the building 50 and are configured to provide structural support of the building 50. Similarly, the upper plurality of studs 96 form a portion of the three walls of the building 50 and are also configured to provide structural support of the building 50. The shorter studs 104 and 108 also form a portion of the wall; however, the shorter studs 104 and 108 provide an opening in the building, such as the plurality of upper floor windows 74-1, 74-2, 74-3, 74-4, and 74-5 shown in FIG. 1. In terms of providing physical support, each of the studs 92, 96, 104, and 108 are mechanically structured and engineered to be able to support a load from the building as well as a load of any associated use of the building. In the present embodiment, the studs 92, 96, 104, and 108 are each constructed of steel; however, it is to be re-emphasized that the studs are not limited to steel. In other embodiments, each of the studs 92, 96, 104, and 108 can be individually modified to various materials, such as those discussed above in connection with the studs 84.

The beams 100 form a portion of a horizontal plane in the module 62. In the present embodiment, the beams 100 are configured to support the floor 102 and the ceiling 103. In the present embodiment, the beams 100 are constructed from galvanized steel. However, the materials from which the beams 100 are constructed are not particularly limited can be modified to be any other type of suitable material such as those discussed above in connection with the beams 88. Furthermore, as discussed above, the module 62 is configured to connect directly above the module 58. It is to be appreciated that since the beams are not located at the top or bottom of the module 62, the module 62 forms a portion of the ground floor as well as a portion of the upper floor. Furthermore, it is to be appreciated with the benefit of this description that the height of each floor is not limited by the size of the module 58 and can extend into another module such as the module 62. In the present embodiment, the floor 102 defines the bottom of the upper floor and the ceiling 103 defines the upper limit of the ground floor. In other embodiments, the module 62 can be modified to exclude one or both of the floor 102 and ceiling 103. For example, in buildings where the upper floor is not used, such as an attic space, there is no need for the floor 102. Similarly, for applications where the building 50 is a storage building, there is no requirement for the ceiling 103 since any aesthetic benefit of hiding the beams 100 is outweighed by the additional cost of the ceiling 103.

Figure 6:
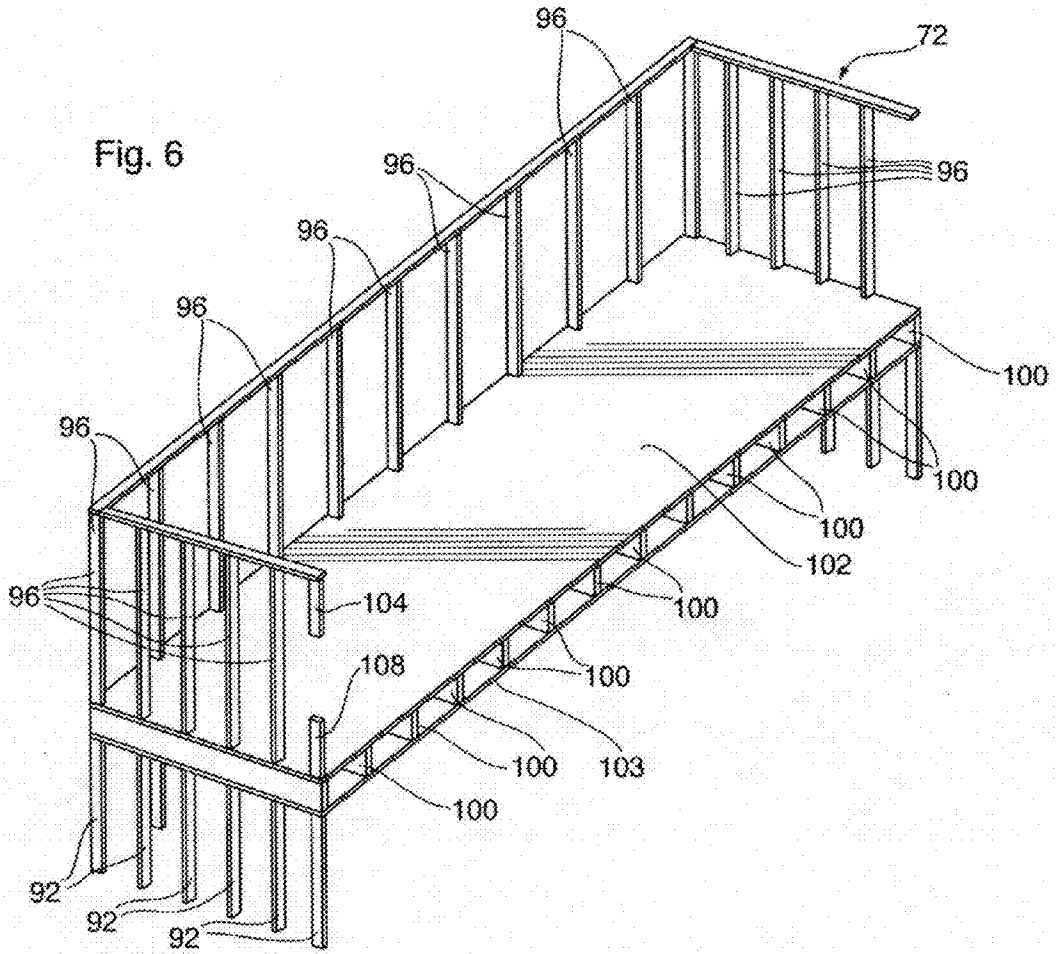
FIG. 6 is a perspective view of components of yet another module of the embodiment of FIG. 1.

Referring to FIG. 6, the module 72 generally has a mirrored structure to that of the module 62 in the present embodiment. In particular, the module 72 also includes a lower plurality studs 92, an upper plurality if studs 96, a plurality of beams 100, a floor 102, a ceiling 103, and shorter studs 104 and 108. In addition to connecting to the module 66 in a similar manner as the module 62 connects to the module 58, the module 72 is also generally configured to connect to the module 62 in a manner similar manner as the module 58 connects to the module 66 as described above.

Figure 7:
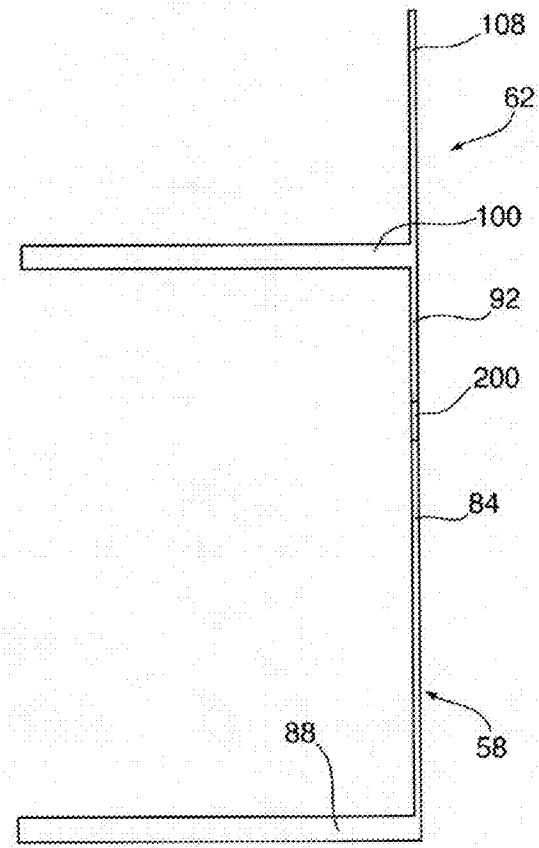
FIG. 7 is a cross-sectional view of the module of FIG. 3 connected to the module of FIG. 5.

In the present embodiment, the module 62 is generally configured to be connected above the module 58 as shown in FIG. 7. In the present embodiment, the lower plurality of studs 92 of the module 62 are generally configured to connect with the corresponding studs 84 of the module 58 using a connecting mechanism 200. It is to be understood that the connecting mechanism 200 is not particularly limited and several modifications to the connecting mechanism 200 involving various types of connectors and/or fasteners are contemplated. Furthermore, the connection mechanism 200 can include more permanent connection means such as welding. In addition, the studs 92 can simply rest on top of the corresponding studs 84 or within a specialized connection mechanism, such as a socket connector. It is to be appreciated that each of the studs 92 of the module 62 may not have a corresponding stud on the module 58. For example, the absence of studs shown in FIG. 3 for providing a gap for the door 70 results in at least one of the studs 92 of the module 62 without a corresponding stud in the module 58. Similarly, the gap for the window 71 leaves at least one of the studs 92 without a corresponding stud in the module 58. In the present embodiment, the studs 92 without a corresponding stud of the module 58 to which the studs 92 can connect can instead be connected to the top of the door frame (not shown) or window frame (not shown). In other embodiments, the studs 92 without a matching stud can be omitted. Although the present embodiment depicts the door 70 and the window 71 extending to the top of the module 58, other embodiments can include openings which do not necessarily extend to the top of the module 58.

Figure 8:
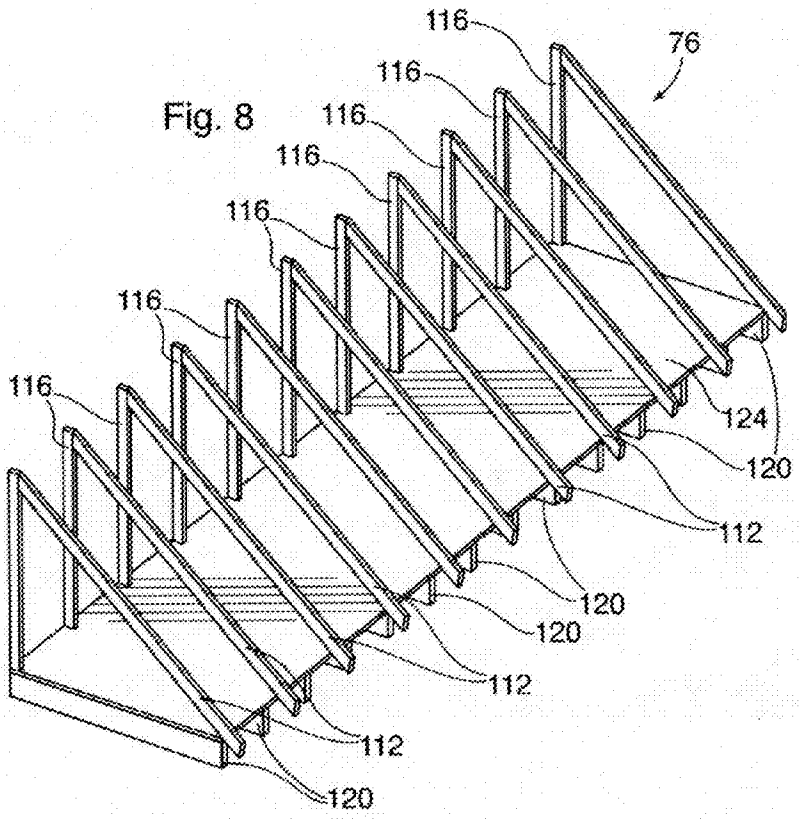
FIG. 8 is a perspective view of components of yet another module of the embodiment of FIG. 1.

Referring to FIG. 8, the module 76 includes a plurality of rafters 112, a plurality of studs 116, a plurality of beams 120 and a floor 124. In the present embodiment, the module 76 forms part of a roofing section of the building 50 and is generally configured to connect directly to the module 62. Therefore, the rafters 112 and the studs 116 are generally configured to support a roof 82 (shown in FIG. 1). In terms of providing physical support, the rafters 112 and the studs 116 are mechanically structured and engineered to be able to support a load from the weight of the roof. The design and spacing of the rafters 112 and the studs 116 is not particularly limited and several variations are contemplated. For example, in some embodiments where the rafters 112 are rigid enough to support the roof 82, the studs 116 can be omitted. In the present embodiment, the rafters 112 and the studs 116 are each constructed of steel; however, it is to be re-emphasized that the rafters 112 and the studs 116 are not limited to steel. In other embodiments, each of the rafters 112 and the studs 116 can be individually modified to various materials, such as those discussed above in connection with the studs 84. The beams 120 form a portion of a horizontal plane in the module 76. In the present embodiment, the beams 120 are configured to support the floor 124. The materials from which the beams 120 are constructed are also not particularly limited can be modified to be any other type of suitable material such as those discussed above in connection with the beams 88.

Figure 9:
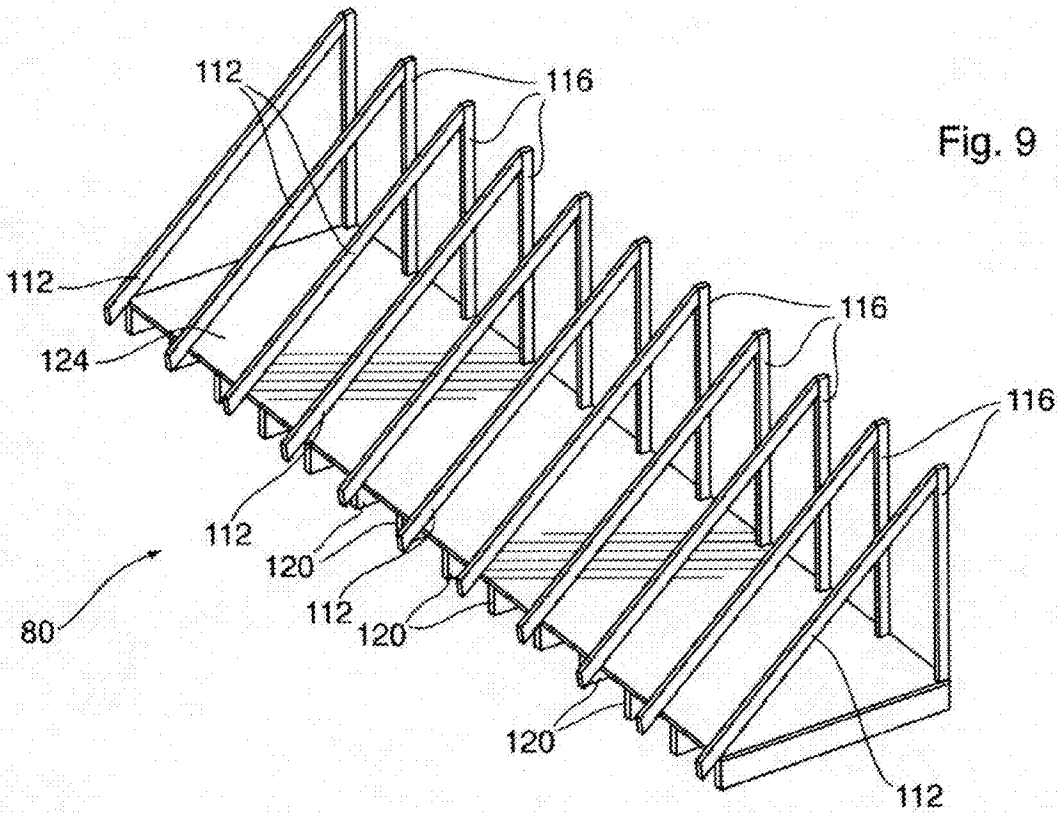
FIG. 9 is a perspective view of components of yet another module of the embodiment of FIG. 1.

Referring to FIG. 9, the module 80 generally has a mirrored structure to that of the module 76 in the present embodiment. In particular, the module 80 also includes a plurality of rafters 112, a plurality of studs 116, a plurality of beams 120 and a floor 124. In addition to connecting to the module 72 in a similar manner as the module 76 connects to the module 62, the module 80 is also generally configured to connect to the module 76 to form the roof 82 of the building 50.

Figure 10:
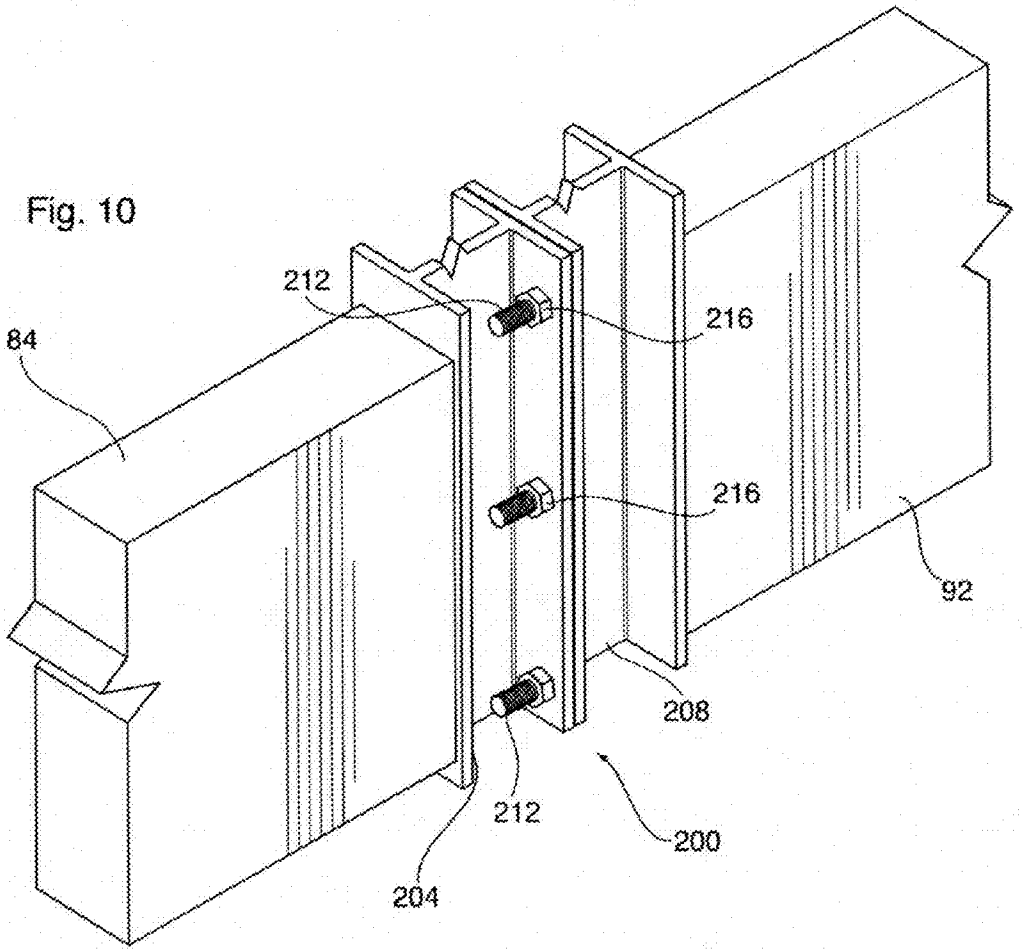
FIG. 10 is a perspective view of a connection mechanism according to an embodiment.

Referring to FIG. 10, an embodiment of the connection mechanism 200 used to connect the module 62 to the module 58 is shown in greater detail. It is to be understood that the connection mechanism 200 is purely exemplary and it will be apparent to those skilled in the art, with the benefit of this description, that a variety of different connection mechanisms are contemplated including those mentioned above already. Although the connection mechanism 200 is shown connecting the stud 84 of the module 58 to the stud 92 of the module 62, it is to be understood that the connection mechanism 200 is not limited to this application. For example, the connection mechanism 200 can be used to connect the beams 88 of the module 58 to corresponding beams of the module 66. The connection mechanism 200 includes a first connection plate 204, a second connection plate 208, a plurality of bolts 212 and a plurality of nuts 216.

In the present embodiment, the first connection plate 204 is connected to the stud 84 and the second connection plate 208 is connected to the stud 92. It is to be understood that the manner in which the connection plates 204 and 208 are connected to the studs 84 and 92, respectively, is not particularly limited. For example, the connection plates 204 and 208 can be welded to the studs 84 and 92, formed from the same material as the studs 84 and 92, or using any other means of connection. In the present embodiment, the first connection plates 204 includes holes which are configured to align with holes of the second connection plate 208. The holes are configured to receive a bolt 212 and can be pre-drilled or drilled at the building location after positioning the module 62. A nut 216 configured to engage the bold 212 can be used to securely fasten the first connection plate 204 to the second connection plate 208. Although three bolts 212 are shown in the present embodiment, it is to be appreciated that the number of bolts used in the connection mechanism can be modified to be greater or less than three depending on the application and the load that the connection mechanism 200 is intended to bear.

Figure 11:
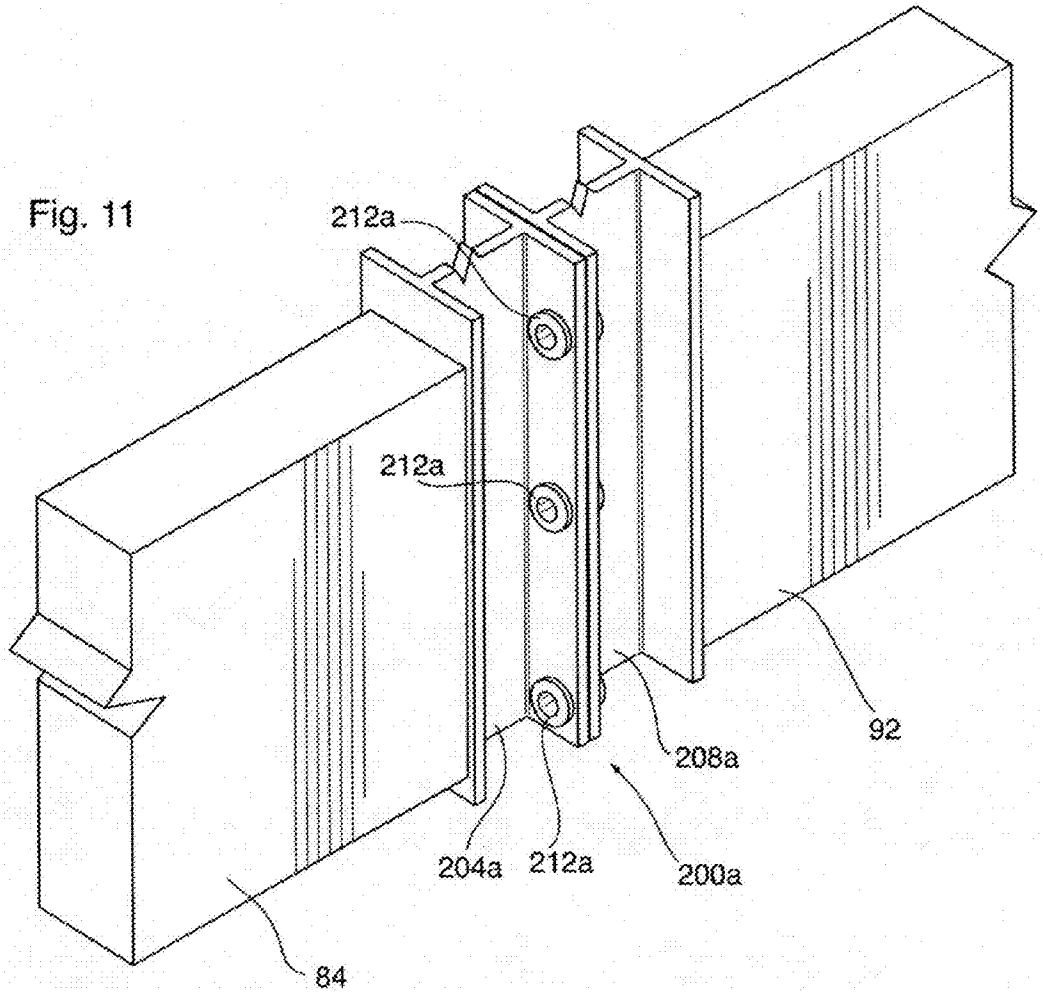
FIG. 11 is a perspective view of a connection mechanism according to another embodiment.

Referring to FIG. 11, another embodiment of a connection mechanism is shown generally at **200*a*. Like components of the connection mechanism 200*a* bear like reference to their counterparts in the connection mechanism 200, except followed by the suffix "a". The connection mechanism 200*a* includes a first connection plate 204*a*, a second connection plate 208*a*, and a plurality of rivets 212*a*. In this embodiment, it is to be appreciated that the connection plates 204*a* and 208*a* are connected to the studs 84 and 92, respectively. The first connection plate 204*a* includes holes which are configured to align with holes of the second connection plate 208*a*. Each hole is configured to receive a rivet 212*a* which can be used to securely fasten the first connection plate 204*a* to the second connection plate 208*a*. Although three rivets 212*a* are shown in the present embodiment, it is to be appreciated that the number of rivets used in the connection mechanism can be modified to be greater or less than three rivets 212*a*** depending on the application.

It will now be appreciated that building 50 can be constructed from various modules which can be customized. Several examples of different modules were discussed above. For example, the modules 58 and 66 provide a portion of the ground floor of the building 50. When connected, the modules 58 and 66 provide four walls of the building as well as openings such as the door 70 and the window 71. The modules 62 and 72 provide an upper portion of the ground floor of the building 50 as well as the upper floor of the building 50. It is to be appreciated that in this embodiment of the building 50, the upper floor has a lower height than the ground floor. Furthermore, the modules 62 and 72 provide openings on the upper floor for the windows 74-1, 74-2, 74-3, 74-4, and 74-5. The height of each floor in the building is not particularly limited and the upper floor can be modified to be taller than the ground floor. The modules 76 and 80 provide the roof 82 of the building 50. It is to be appreciated that each of the modules 58, 62, 66, 72, 76, and 80 can be modified to provide further features such as additional openings, interior walls, interior pillars, interior doorways, staircases, additional structural supports and other fixtures. Indeed, a plurality of different configurations for each module is contemplated herein.

Figure 12:
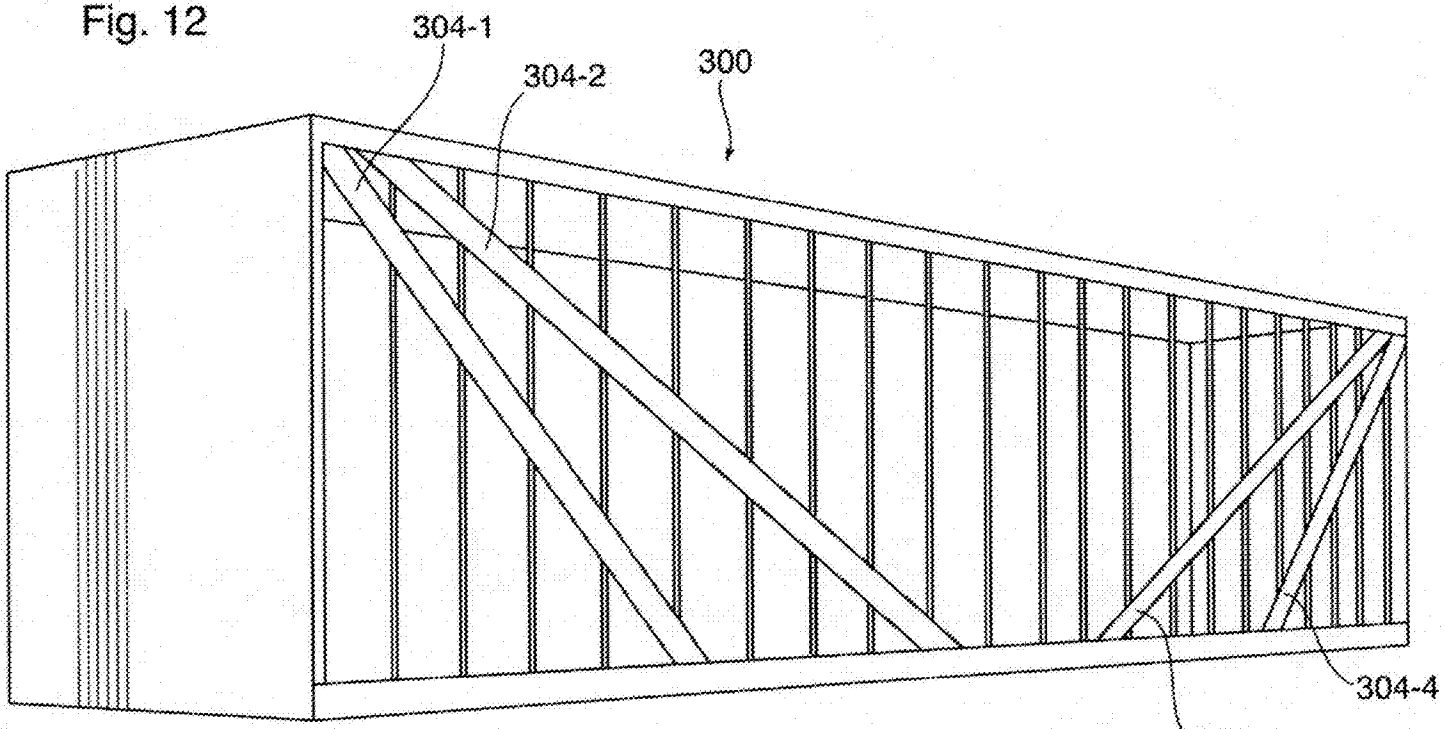
FIG. 12 is a perspective view of a module according to another embodiment.

FIG. 12 provides a view of another exemplary module 300. The module 300 can be similar to the module 58 described above. However, the module 300 includes a plurality of load bearing diagonals 304-1, 304-2, 304-3, and 304-4. The load bearing diagonals provide the module 300 with additional structural support in the wall such that more load can be placed on top of the module 300. It is to be appreciated that the load bearing diagonals are but one means of increasing the structural support and that various other features are contemplated. For example, in other embodiments, larger studs or studs of different materials can be substituted to increase the structural support.

Figure 13:
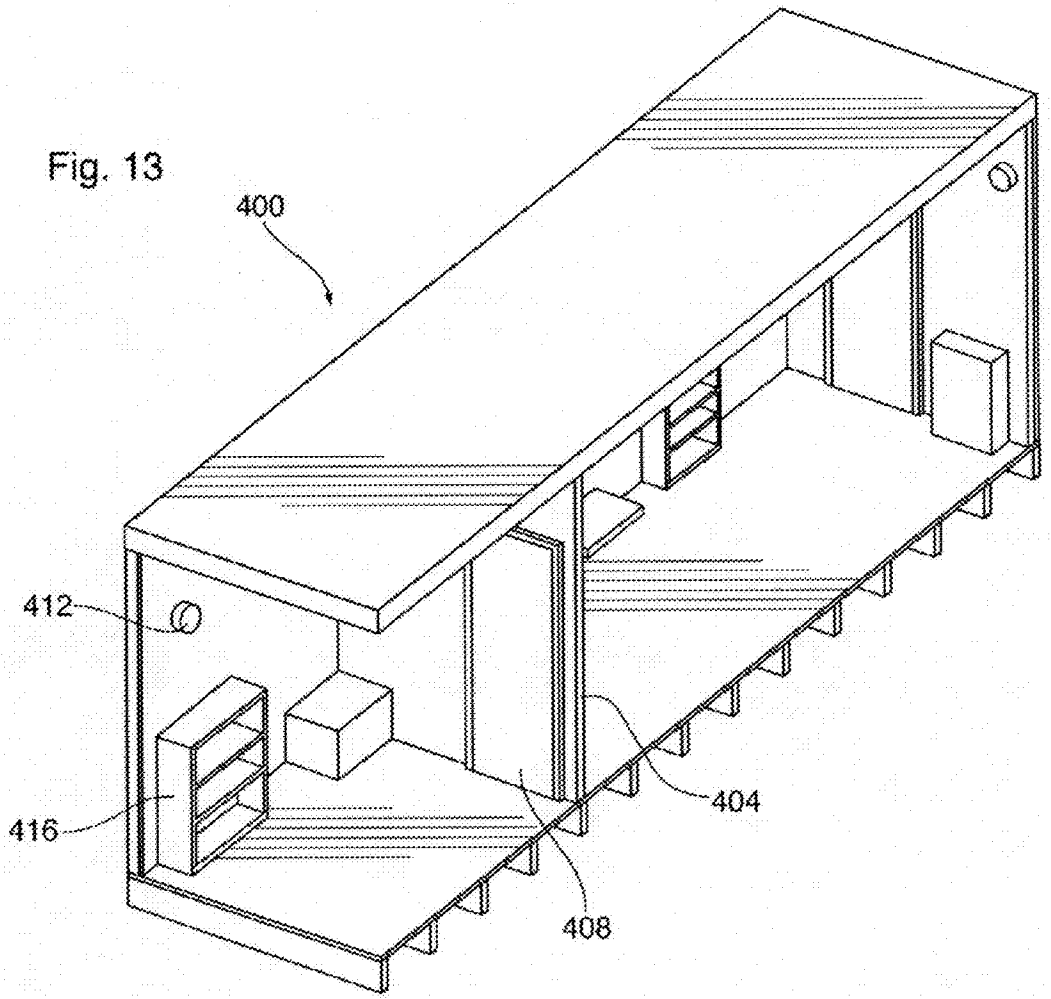
FIG. 13 is a perspective view of a module according to yet another embodiment.

FIG. 13 provides a view of yet another exemplary module 400. The module 400 includes an interior wall 404, an interior door 408, a light fixture 412, shelving 416 and other interior components such as cabinets (not shown). The interior wall 404 and interior door 408 can be used to define separate rooms within a completed building. In the module 400, it is to be understood that the walls of the module 400 are prefabricated with all the electrical connections of an electrical system installed. In other embodiments, the module 400 can be modified to include a plumbing system having piping such that after construction of the building 50, the module 400 can simply be connected to electricity supply, a water supply and a water drain.

It is to be understood that the building 50 can be constructed by substitution modules to create different configurations, highlighting one of the advantages of the present invention. For example, the modules 300 and 400 can used to substitute any one of the modules 58, 62, 66, 72, 76, and 80 if the features of the modules 300 and 400 are desired. For example, by substituting the module 58 with the module 300, a more rigid building is constructed using additional structural support of the load bearing diagonals 304-1, 304-2, 304-3, and 304-4. As another example, by substituting the module 66 with the module 400, the building 50 is constructed with interior features such as a portion of an interior wall in place to reduce the amount of labor at the location of the building 50 by shifting the labor to an off-site facility.

Figure 14:
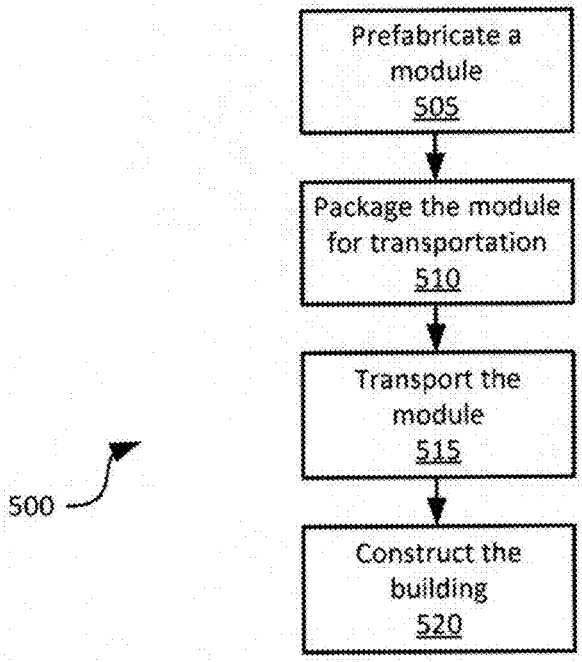
FIG. 14 is a flow chart of a method for constructing a building.

Referring to FIG. 14, a method for constructing a prefabricated building 50 is represented in the form of a flow-chart and indicated generally at 500. In the present embodiment, the method 500 can be implemented using components of the prefabricated building 50 described above. However, it is to be understood that the method 500 is not limited to the construction of the building 50 and can be implemented on a wide variety of different buildings. Furthermore, the following discussion of the method 500 will lead to a better understanding of the components of the building 50 such as the base 54 and the modules 58, 62, 66, 72, 76, and 80. In addition, it is to be appreciated that the method 500 need not be performed in the exact sequence as shown, hence the elements of the method are referred to herein as "blocks" rather than "steps". For example, some of the blocks can also be performed in parallel prior to completion of the previous block.

Beginning at block 505, the modules 58, 62, 66, 72, 76, and 80 are prefabricated at an off-site facility specializing in the fabrication of modules in general. By prefabricated modules off-site at a facility specializing in manufacturing modules, the amount of labor needed at the site of the building can be decreased. Therefore, it is to be understood that considerable cost savings can be achieved. For example, the cost savings can result from manufacturing the modules at an off-site location having lower construction costs, such as lower wages, lower building material costs, and greater access to building materials. At the same time, the construction can be performed in a controlled facility which is protected from inclement weather and is subject to ongoing and sophisticated quality control techniques. As another example, the manufacturing process can also be moved to a facility capable of producing modules on an assembly line.

Each of the modules 58, 62, 66, 72, 76, and 80 are prefabricated such that they fit within a predetermined volume, highlighting a further advantage of the present invention. The predetermined volume is generally dependent on factors involved with transporting the modules 58, 62, 66, 72, 76, and 80 from the off-site facility to the building location. In the present embodiment, each of the modules 58, 62, 66, 72, 76, and 80 is configured to fit within a standard intermodal shipping container. In particular, each of the modules 58, 62, 66, 72, 76, and 80 are configured to fit within a intermodal shopping container having outside dimensions of about 40 feet× about 8 feet×about 9.5 feet. It is to be appreciated that by putting each of the modules 58, 62, 66, 72, 76, and 80 into the intermodal shipping container, the cost of transportation decreases significantly across all types of surface transportation means such as container ship, trucks, or rail. In other embodiments, the predefined volume can be larger or smaller as in accordance with the demands of other transportation means, such as a non-standard transportation means. Although modules can each be of a different size, it is to be appreciated that by transporting modules of similar sizes, the same transportation means can be easily used to transport each of the modules 58, 62, 66, 72, 76, and 80 interchangeably without requiring customized transportation means for each module.

Figure 15:
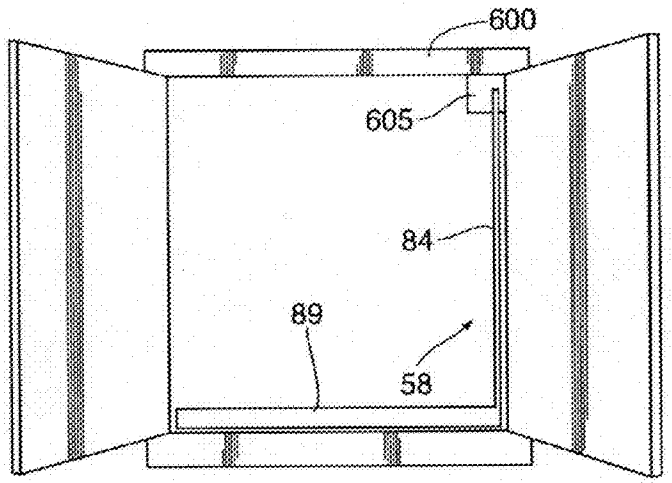
FIG. 15 is a end view of a module according to an embodiment inside a shipping container.
Figure 16:
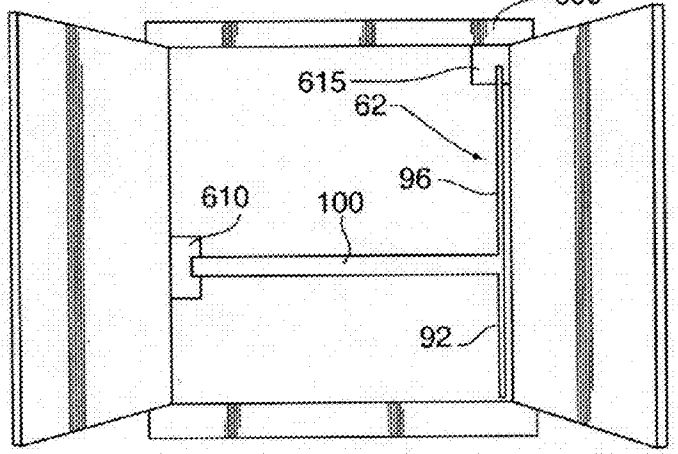
FIG. 16 is a end view of a module according to another embodiment inside a shipping container in accordance with an embodiment.

Block 510 comprises packaging each of the modules 58, 62, 66, 72, 76, and 80 for transporting. In the present embodiment, each of the modules 58, 62, 66, 72, 76, and 80 are placed within a shipping container 600 for ease of transportation. Referring to FIG. 15, the module 58 is shown inside a shipping container 600. The module 58 is firmly held in place in the container 600 using at least one bracket 605 connected with at least one of the studs 84. Referring to FIG. 16, the module 62 is shown inside a shipping container 600. The module 62 is firmly held in place in the container 600 using at least one bracket 610 connected with at least one of the beams 100 and at least one bracket 615 connected with at least one of the studs 96. It is to be appreciated that the manner in which each of the modules 58, 62, 66, 72, 76, and 80 is packaged is not particularly limited and that only two of many different types of modules are shown as examples in FIGS. 15 and 16. For example, the module 76 is also configured to fit in the container 600 using brackets designed for the module 76 to prevent the module 76 from shifting during transportation.

Although the embodiments discussed above involve placing a module inside the shipping container 600, it is re-emphasized that the embodiment described is a non-limiting example only. For example, in applications where a shipping container is not to be used, the modules 58, 62, 66, 72, 76, and 80 can be placed on top of a flatbed trailer for transporting without a shipping container. In other embodiments, temporary covers such as metal, wood or plastic panels or simply plastic sheets can be used to cover and protect the modules 58, 62, 66, 72, 76, and 80 during transportation.

Figure 17:
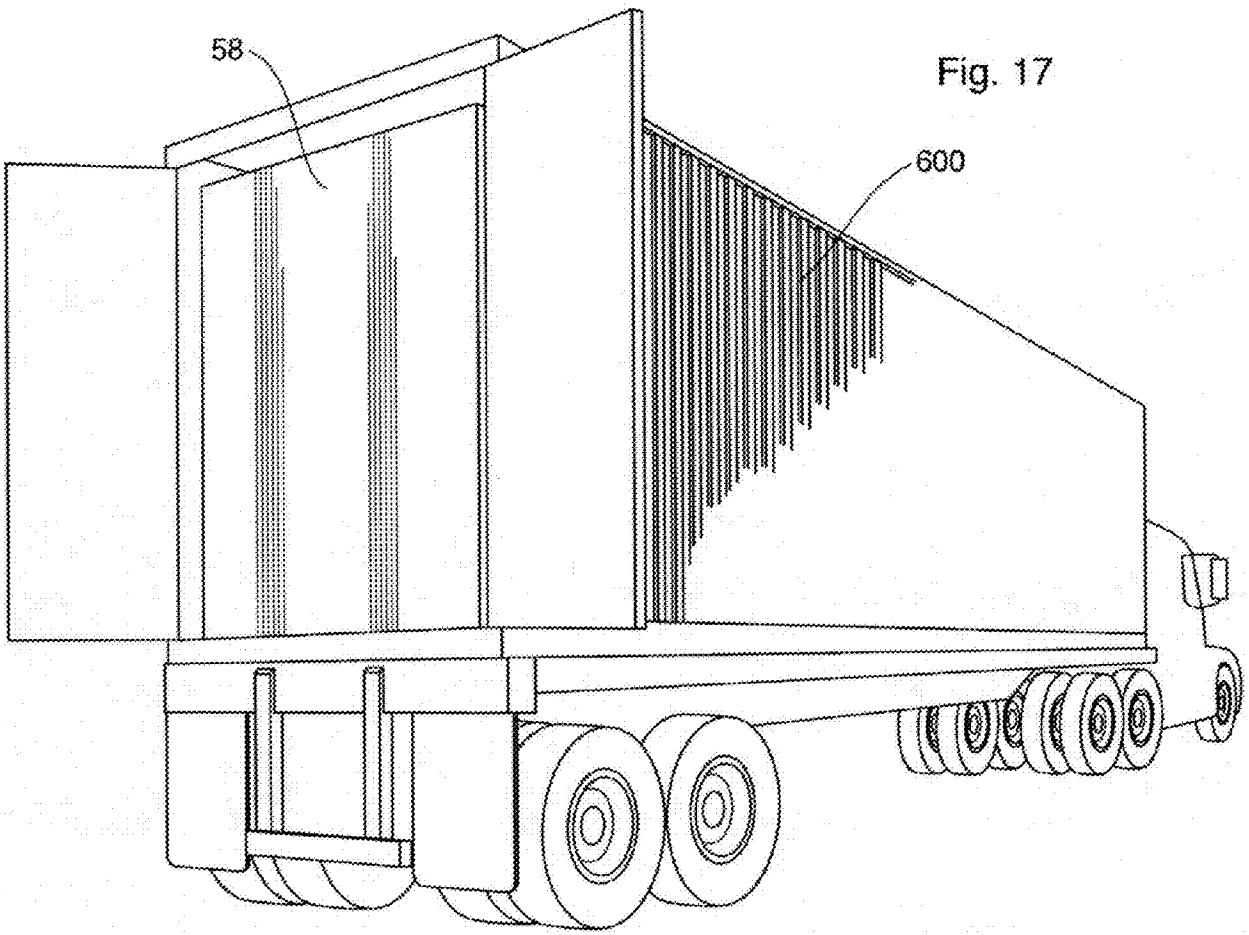
FIG. 17 is a perspective view of a module according to another embodiment inside a shipping container on a truck.
Figure 18:
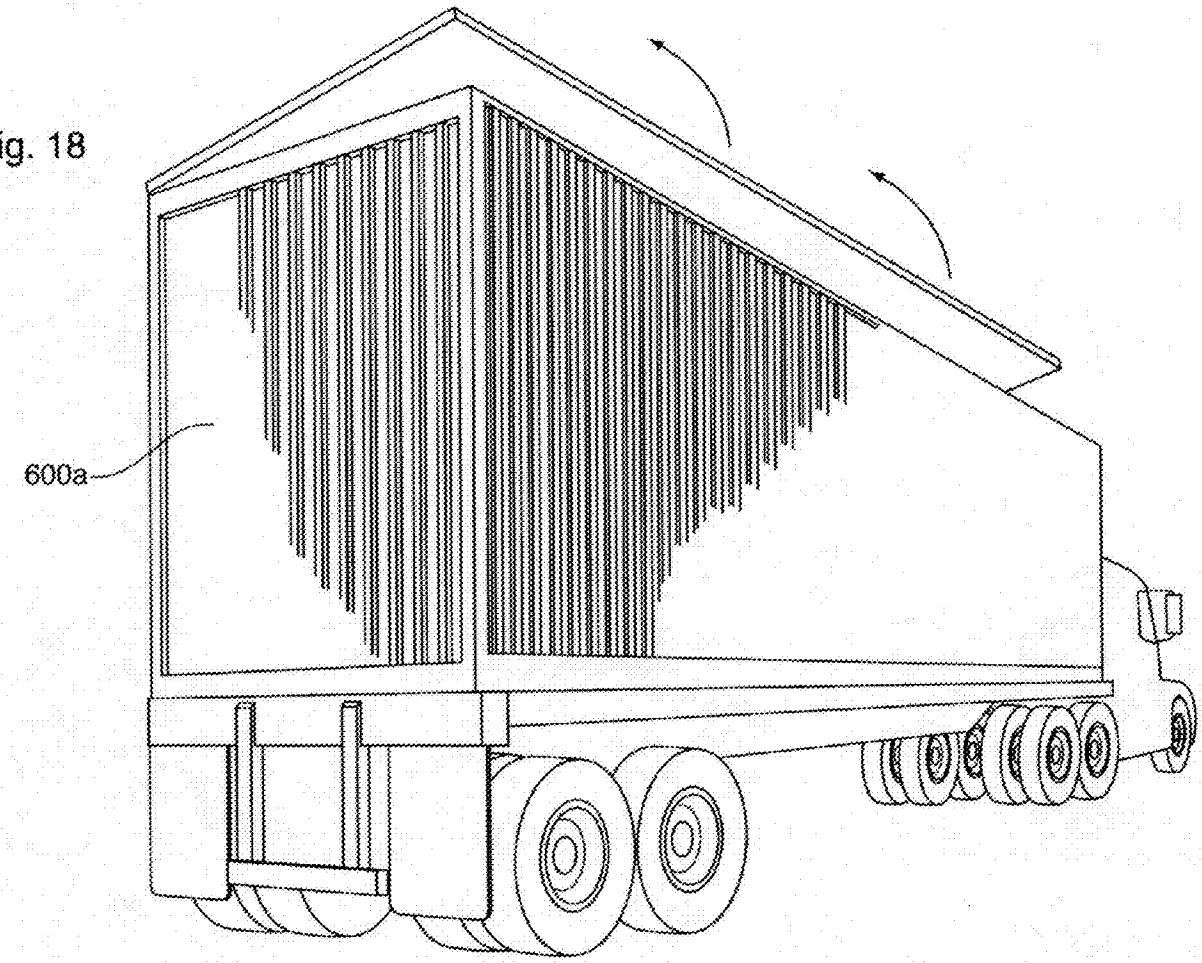
FIG. 18 is a perspective view of a shipping container on a truck in accordance with another embodiment.

Block 515 comprises transporting the modules 58, 62, 66, 72, 76, and 80 to the building location. It is to be understood that the method for transporting the modules 58, 62, 66, 72, 76, and 80 are not particularly limited and that several methods are contemplated. For example, each module can be transported by ship, train, or trucks. In addition, the modules can also be transported using planes or helicopters. As an example of transportation, FIG. 17 shows the module 58 inside the container 600 being towed by a truck. As another example, FIG. 18 shows a different type of container **600*a* used to transport the module 58. In the embodiment shown in FIG. 18, the container opens from the top instead of at an end such that the module 58** can be placed into or removed from the container easily using a crane (not shown). This highlights a further advantage of the present invention which is that standard shipping techniques can be used thereby mitigating or obviating problems with having to develop special shipping methods, and/or obtain special permits to carry oversized loads on highways.

Block 520 comprises constructing the building 50 using the modules 58, 62, 66, 72, 76, and 80. In the present embodiment, the modules are placed on top of the base 54 using a crane. The modules 58, 62, 66, 72, 76, and 80 are then connected to each other in using the connection mechanisms 200. After the modules 58, 62, 66, 72, 76, and 80 are connected to each other, the building 50 is connected to various external hookups such as water and electricity. In the present embodiment, each of the modules 58, 62, 66, 72, 76, and 80 is prefabricated with an electrical system, such as electrical wiring, and a plumbing system, such as a plurality of pipes, installed. Therefore, in addition to connecting the frames of the modules 58, 62, 66, 72, 76, and 80, each of the modules 58, 62, 66, 72, 76, and 80 would include electrical and plumbing hookups configured to be connected to an adjacent module. Therefore, in the present embodiment, a single connection point to an external hookup can service the entire building 50. In other embodiments, multiple hookups can be used for redundancy and/or to avoid interconnecting each module.

Block 520 also includes installing additional fixtures which were not installed at the prefabrication stage into the completed building 50. For example, fixtures that are highly customizable such as flooring or window coverings, as well as fixtures which can be too fragile to ship, such as chandeliers, can be easily added.

In general terms, the building 50 is constructed from a plurality of modules 58, 62, 66, 72, 76, and 80 connected together and resting on the base 54. However, it is to be re-emphasized that the structure shown in FIGS. 1 and 2 is a schematic, non-limiting representation only. For example, although the building 50 is constructed using six modules, it is to be understood that the building 50 can be modified to include more or less than 6 modules, where the modules are connected using connection mechanisms such as the connection mechanisms 200. Furthermore, it the building 50 can be further modified such that different portions of the building are of different height. Indeed, a plurality of different configurations of modules to construct a building is contemplated herein.

Figure 19:
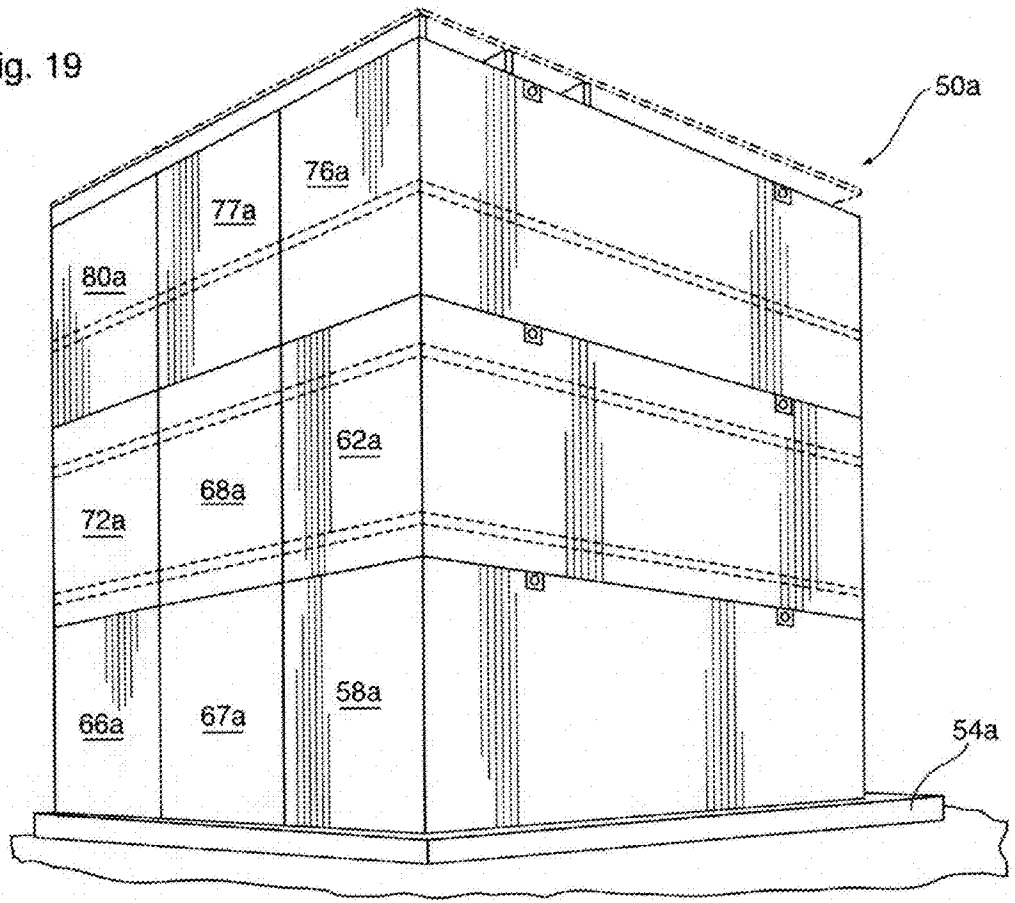
FIG. 19 is a schematic showing the modules of the prefabricate building in accordance with another embodiment.
Figure 20:
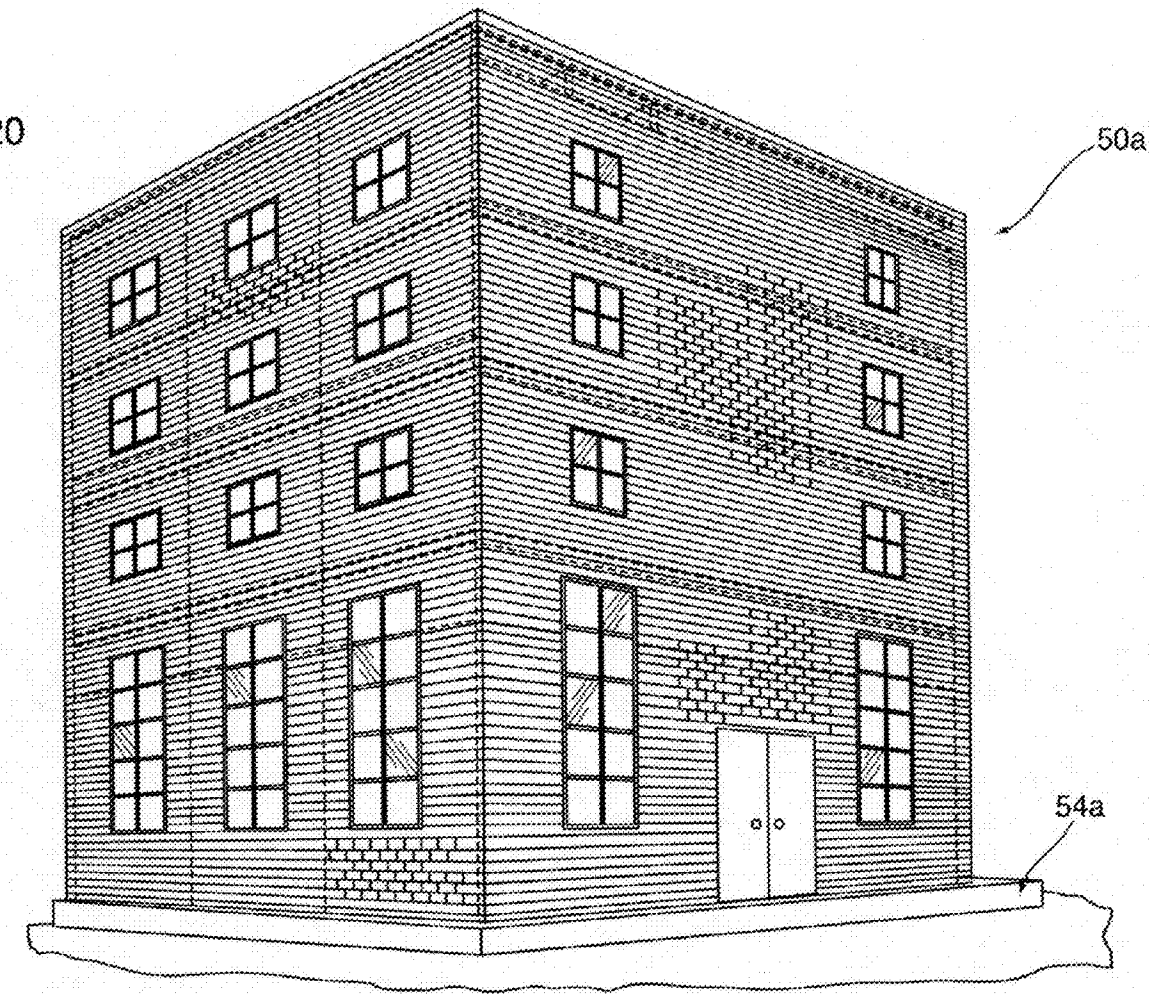
FIG. 20 is a perspective view of the prefabricated building according to the embodiment of FIG. 19.

Referring to FIGS. 19 and 20, another embodiment of a prefabricated building is indicated at 50*a*. Like components of the building 50*a* bear like reference to their counterparts in the building 50, except followed by the suffix "a". The building 50*a* includes a base 54*a* and a plurality of modules 58*a*, 62*a*, 66*a*, 67*a*, 68*a*, 72*a*, 76*a*, 77*a*, and 80*a*. It is to be understood that the building 50*a* is purely exemplary and that a variety of different prefabricated buildings are contemplated. In this embodiment, the building 50*a* is shown to include nine modules 58*a*, 62*a*, 66*a*, 67*a*, 68*a*, 72*a*, 76*a*, 77*a*, and 80*a* instead of the six modules 58, 62, 66, 72, 76, and 80 of the building 50. Therefore, it is to be appreciated that the building 50*a* occupies a larger area and the base 54*a* than the base 54. Furthermore, as shown in FIG. 13, the building 50*a* includes a flat roof instead of the angled roof 82 of the first building. By using a flat roof, the building 50*a* increases the usable volume within the building. Building 50*a* thus highlights one of the advantages of the present invention which is that a variety of building structures can be accommodated while advanced manufacturing techniques can be used and traditional shipping techniques can be sued.

Variations of the above description are contemplated and within the scope of this description. For example, although the building 50 and the building 50*a* involve six and nine modules respectively, any number of modules from as low as two modules to several hundred modules are contemplated.

Figure 21:
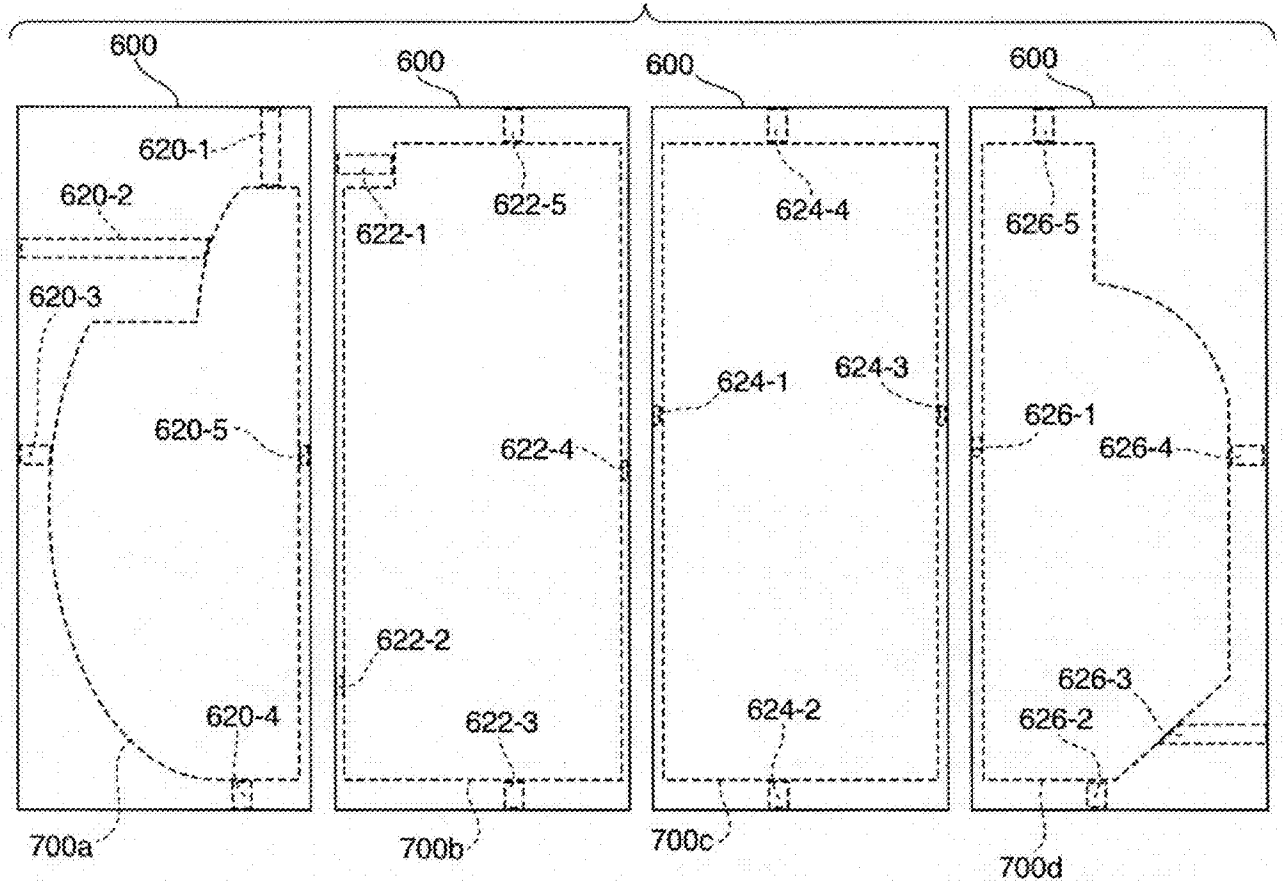
FIG. 21 is a top view is a perspective view of modules according to another embodiment inside shipping containers.

Furthermore, although the modules 58, 62, 66, 72, 76, and 80 and the modules 58*a*, 62*a*, 66*a*, 67*a*, 68*a*, 72*a*, 76*a*, 77*a*, and 80*a* are generally rectangular in shape, it is to be understood that shape is not particularly limited. Referring to FIG. 21, four custom shaped modules 700*a*, 700*b*, 700*c*, and 700*d* are shown within a plurality of containers 600. The module 700*a* includes a curved section and is held in place during transportation using a plurality of brackets 620-1, 620-2, 620-3, 620-4, and 620-5, which are configured to accommodate the irregular shape of the module 700*a*. The module 700*b* includes an irregular corner and is similarly held in place during transportation using a plurality of brackets 622-1, 622-2, 622-3, 622-4, and 622-5. The module 700*c* is held in place during transportation using a plurality of brackets 624-1, 624-2, 624-3, 624-4, and 624-5. The module 700*d* also includes a curved section and is held in place during transportation using a plurality of brackets 626-1, 626-2, 626-3, 626-4, and 626-5. By using non-rectangular shapes, the shape of each module is not limited to a rectangular shape or any other type of regular shape which provides for a large variety of buildings having different shapes. Therefore, it is to be appreciated, with the benefit of this specification, that greater flexibility in the design and structural appearance of buildings, with incidental aesthetic flexibility, is provided. Using transportation containers to transport the modules 700*a*, 700*b*, 700*c*, and 700*d* allow for easier transportation as each of the modules 700*a*, 700*b*, 700*c*, and 700*d* would be securely stored and protected from the elements by the container 600.

In the embodiment shown in FIG. 21, it is to be appreciated that the modules 700*a*, 700*b*, 700*c*, and 700*d* together form a portion of at least one floor. The number of floors or portion of floors form by the modules 700*a*, 700*b*, 700*c*, and 700*d* is not particularly limited. For example, the modules 700*a*, 700*b*, 700*c*, and 700*d* can form a portion of a floor greater than the height of the module. Alternatively, the modules can form a portion of multiple floors similar to the modules 62 and 72 discussed above. In another example, the modules can each individually form a different number of floors such that some portions of the building have higher ceilings than other parts, for example, a lobby with higher ceilings.

In the present embodiment shown in FIG. 21, the module 700*a* connects with the module 700*b*. In turn, the module 700*b* connects to the module 700*c* on the side opposite of the connection with module 700*a*. Similarly, the module 700*c* connects to the module 700*d* on the side opposite of the connection with module 700*b*. It is to be understood that the manner of connecting the modules 700*a*, 700*b*, 700*c*, and 700*d* are not particularly limited and several different manners of connecting the modules 700*a*, 700*b*, 700*c*, and 700*d* are contemplated. For example, connecting the modules 700*a*, 700*b*, 700*c*, and 700*d* can include various fasteners, discussed above such as the connection mechanism 200 and 200*a*, to fasten beams of the modules 700*a*, 700*b*, 700*c*, and 700*d* to the corresponding beams of the adjacent module to form a single horizontal plane across all of the modules 700*a*, 700*b*, 700*c*, and 700*d*. In other embodiments, the modules 700*a*, 700*b*, 700*c*, and 700*d* can also have offset floors such that more than one horizontal plane will be formed. In further embodiments, the modules 700*a*, 700*b*, 700*c*, and 700*d* can be connected by positioning the modules 700*a*, 700*b*, 700*c*, and 700*d* adjacent to each other on a base and using the frictional force between each of the modules 700*a*, 700*b*, 700*c*, and 700*d* and the base to hold the modules 700*a*, 700*b*, 700*c*, and 700*d* in place.

Furthermore, it is to be understood that each of the modules 700*a*, 700*b*, 700*c*, and 700*d* can include some interior components such as an interior wall, an interior door, a light fixture, and shelving. Furthermore, it is to be understood that the walls of each of the modules 700*a*, 700*b*, 700*c*, and 700*d* can be prefabricated with all the electrical connections of an electrical system installed. In addition, the modules 700*a*, 700*b*, 700*c*, and 700*d* can also include a plumbing system having piping such that after construction of the building, the modules 700*a*, 700*b*, 700*c*, and 700*d* can simply be connected to electricity supply, a water supply and a water drain.

It is to be understood that many combinations, variations and subsets of the embodiments and teachings herein are contemplated. As a non-limiting example, the modules 58, 62, 66, 72, 76, and 80 can be interchanged with the modules 58*a*, 62*a*, 66*a*, 67*a*, 68*a*, 72*a*, 76*a*, 77*a*, and 80*a*. As another non-limiting example, the building 50 can be modified to have a flat roof and the building 50*a* can be modified to have an angled roof.

Various advantages will now be apparent with the benefit of this specification. Of note is the ability to construct modules for a prefabricated building at an off-site facility for significantly lower costs and subsequently shipping the modules to the building location for a fast and relatively lower labor intensive construction process. By packaging all the modules within a predetermined volume, the transportation of similarly sized modules reduces the logistics involved in planning the transportation of the modules from the off-site facility to the building location. Since the shape of each module is not limited, there is no significant loss in designing buildings with varied structural shapes, with incidental benefit of providing flexibility in aesthetic designs, using the method and apparatus described herein. Therefore, it is to be appreciated that significant cost savings in constructing buildings is reduced.

While specific embodiments have been described and illustrated, such embodiments should be considered illustrative only and should not serve to limit the accompanying claims.

What is claimed is:

1. A prefabricated building comprising:

a base;

a first module for resting on the base, the first module comprising:

a plurality of first module beams for forming a portion of a first horizontal plane; and a plurality of first module studs for forming a first portion of a wall, the plurality of first module studs connected to the plurality of first module beams; and a second module for connecting to the first module, the second module comprising:

a plurality of second module beams for forming a portion of a second horizontal plane; and a plurality of second module studs for forming a second portion of the wall, the plurality of second module studs connected to the plurality of second module beams, and the plurality of second module studs connected directly to the plurality of first module studs for connecting the first module to the second module such that the plurality of first module studs and the plurality of second module studs are connected between the first horizontal plane and the second horizontal plane, wherein the first module and the second module are configured to fit within a predetermine volume.

2. The prefabricate house of claim 1, wherein the first module and the second module each comprises electrical wiring.

3. The prefabricate house of claim 2, wherein the first module comprises a first electrical system.

4. The prefabricate house of claim 3, wherein the second module comprises a second electrical system.

5. The prefabricate house of claim 4, wherein the first electrical system is configured to be connected to the second electrical system.

6. The prefabricate house of claim 1, wherein the first module beams comprise galvanized steel.

7. The prefabricate house of claim 6, wherein the second module beams comprise galvanized steel.

8. The prefabricate house of claim 1, wherein the first module studs comprise galvanized steel.

9. The prefabricate house of claim 8, wherein the second module studs comprise galvanized steel.

10. The prefabricate house of claim 1, wherein the predefined volume is configured to fit within a shipping container.

11. The prefabricate house of claim 10, wherein the shipping container is an intermodal shipping container.

12. The prefabricate house of claim 1, wherein the base includes an insulating material.

13. The method for constructing a building, the method comprising:

prefabricating a first module having a plurality of first module beams for forming a portion of a first horizontal plane and a plurality of first module studs for forming a first portion of a wall, the plurality of first module studs connected to the plurality of first module beams;

prefabricating a second module having a plurality of second module beams for forming a portion of a second horizontal plane and a plurality of second module studs for forming a second portion of the wall, the plurality of second module studs connected to the plurality of second module beams, and the plurality of second module studs connected directly to the plurality of first module studs such that the plurality of first module studs and the plurality of second module studs are connected between the first horizontal plane and the second horizontal plane;

packaging the first module and the second module for transportation;

transporting the first module and the second module to a building location;

constructing the building using the first module and the second module, wherein at least one of the first module or the second module is placed on a base.

14. The method of claim 13, wherein prefabricating the first module comprises prefabricating the first module at an off-site facility.

15. The method of claim 13, wherein prefabricating the first module comprises installing an electrical system.

16. The method of claim 13, wherein prefabricating the first module comprises installing a plumbing system.

17. The method of claim 13, wherein prefabricating the first module comprises installing fixtures.

18. The method of claim 13, wherein packaging comprises placing the first module in a first shipping container and placing the second module in a second shipping container.

19. The method of claim 18, wherein placing the first module in a first shipping container comprises holding the module in place with a first bracket and placing the second module in a second shipping container comprises holding the module in place with a second bracket.

20. The method of claim 13, wherein constructing comprises connecting the first module to the second module using a connection mechanism.

* * * * *